US010785573B2

(12) United States Patent
Kim

(10) Patent No.: US 10,785,573 B2
(45) Date of Patent: Sep. 22, 2020

(54) SPEAKER DEVICE FOR VEHICLE

(71) Applicants: Hyundai Motor Company, Seoul (KR); Kia Motors Corporation, Seoul (KR)

(72) Inventor: Youngbeom Kim, Bucheon-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/566,346

(22) Filed: Sep. 10, 2019

(65) Prior Publication Data

US 2020/0221232 A1 Jul. 9, 2020

(30) Foreign Application Priority Data

Jan. 8, 2019 (KR) ..... 10-2019-0002032

(51) Int. Cl.
*H04R 9/06* (2006.01)
*H04R 9/02* (2006.01)

(52) U.S. Cl.
CPC ..... *H04R 9/06* (2013.01); *H04R 9/025* (2013.01); *H04R 2400/11* (2013.01); *H04R 2499/13* (2013.01)

(58) Field of Classification Search
CPC ..... H04R 9/00–18; H04R 2400/07; H04R 2400/11; H04R 2499/13; H04R 9/025; H04R 9/027
See application file for complete search history.

(56) References Cited

U.S. PATENT DOCUMENTS 4,465,906 A * 8/1984 Adolph ..... H04R 9/025 335/231
5,434,458 A * 7/1995 Stuart ..... H04R 9/045 310/13
5,539,262 A * 7/1996 Strugach ..... H02K 41/0356 310/13
2006/0110001 A1* 5/2006 Saint Vincent ..... H04R 9/066 381/396
2006/0115107 A1* 6/2006 Vincent ..... H04R 9/025 381/412
2019/0004566 A1* 1/2019 Lee ..... H04R 9/06

FOREIGN PATENT DOCUMENTS

KR 10-2004-0062424 A 7/2004

* cited by examiner

*Primary Examiner* — Mark Fischer
(74) *Attorney, Agent, or Firm* — Morgan, Lewis & Bockius LLP

(57) ABSTRACT

A speaker device for a vehicle having a structure in which a seating direction and a magnetic path forming direction of a magnet coincide with each other, may include a frame, a magnet mounted in the frame to generate a magnetic flux, a yoke having a magnetic gap to form a magnetic path generated by the magnet, a voice coil mounted in the magnetic gap to move when a current is applied, a diaphragm engaged to the voice coil and configured to vibrate according to movement of the voice coil and generate a negative pressure, and a plate configured to support the magnet, wherein the magnet is accommodated in a horizontal direction such a seating direction and a magnetic path forming direction of the magnet coincide with each other.

9 Claims, 3 Drawing Sheets

SPEAKER DEVICE FOR VEHICLE

CROSS-REFERENCE TO RELATED APPLICATION(S)

The present application claims priority to Korean Patent Application No. 10-2019-0002032, filed on Jan. 8, 2019, the entire contents of which is incorporated herein for all purposes by this reference.

BACKGROUND OF THE INVENTION

Field of the Invention

The present invention relates to a speaker device for a vehicle, and more particularly to a speaker device for a vehicle having a structure in which a seating direction and a magnetic path forming direction of a magnet coincide with each other.

Description of Related Art

Recently, it has become common for passengers who ride in a vehicle to enjoy video/audio equipment such as a TV, a video, etc. In addition to a radio, a CD player, and a MP3 in the vehicle. Sound waves from such video/audio equipment are usually output to the interior of the vehicle through a speaker mounted in a vehicle body such as a door.

In general, the speaker may include a magnet for generating magnetic flux, a yoke for providing a path of magnetic flux, a magnetic circuit including a bobbin on which a voice coil is wound, a diaphragm that vibrates according to the movement of the bobbin, a damper for adjusting a vibration direction of the diaphragm, and a vibration system including an edge portion for fixing an external rim of the diaphragm to a frame.

Therefore, when a current is applied to the voice coil, the magnetized voice coil interacts with the magnetic flux generated from the magnet to move forwards and backwards thereof, generating negative pressure by vibrating the diaphragm.

Such a speaker has a disadvantage in that the seating direction (horizontal) and the magnetic path forming direction (vertical) of the magnet (permanent magnet) do not coincide with each other, decreasing the efficiency and increasing the size of the magnet.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a speaker device configured for a vehicle having a structure in which the seating direction and the magnetic path forming direction of a magnet coincide with each other.

Various aspects of the present invention are directed to providing a speaker device configured for a vehicle that reduces the size of the magnet to increase the efficiency.

Various aspects of the present invention are directed to providing a speaker device configured for a vehicle that improves the shape of a plate to increase the efficiency by smoothly flowing a magnetic flux.

Additional various aspects of the present invention will be set forth in part in the description which follows and, in part, will be obvious from the description, or may be learned by practice of the present invention.

In accordance with an aspect of the present invention, a speaker device configured for a vehicle may include a frame, a magnet mounted in the frame to generate a magnetic flux, a yoke having a magnetic gap to form a magnetic path generated by the magnet, a voice coil mounted in the magnetic gap to move when a current is applied, a diaphragm engaged to the voice coil and configured to vibrate according to movement of the voice coil and generate a negative pressure, and a plate configured to support the magnet, wherein the magnet is accommodated in a horizontal direction such a seating direction and a magnetic path forming direction of the magnet coincide with each other.

The magnet is mounted on the same line as the magnetic path forming direction thereof.

The plate may include a first plate portion and a second plate portion extending downwardly from the first plate portion and formed to have a width wider than the width of the first plate portion.

The plate is formed of an L shape.

A spacer is provided at a lower portion of the magnet and the plate to prevent leakage magnetic flux.

The spacer is formed of a non-magnetic material.

The plate is provided to be injection-molded integrally with the frame.

The plate is formed in a shape of to be injection-molded integrally with at least a portion of the frame.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
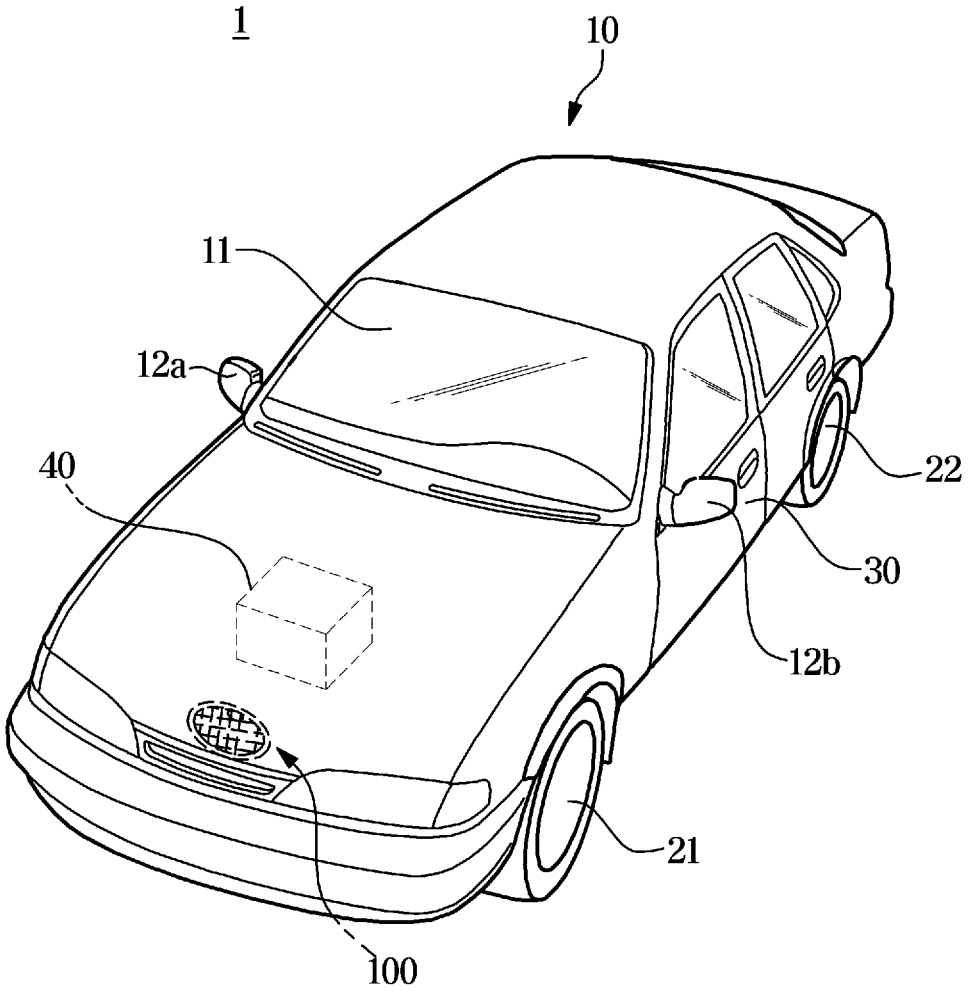
FIG. 1 is a view exemplarily illustrating a vehicle provided with a speaker device according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

The exemplary embodiments described herein and the configurations shown in the drawings are only examples of exemplary embodiments of the present invention, and various modifications may be made at the time of filing of the present invention to replace the exemplary embodiments and drawings of the exemplary embodiment of the present invention.

Like reference numbers or designations in the various figures of the present invention represent parts or components that perform substantially the same functions.

The terms used herein are for describing the exemplary embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present invention, the first component may be referred to as a second component, and similarly, the second component may also be referred to as a first component. The term "and/or" includes any combination of a plurality of related items or any one of a plurality of related items.

In the exemplary embodiment, the terms "front," "rear," "upper," "lower," "left," and "right" are defined with reference to the drawings, and the shape and position of each component are not limited by these terms.

In the following description, a vehicle refers to various devices for moving an object to be transported, such as a person, a thing, or an animal, from an origin to a destination. The vehicle may include a vehicle that runs on roads or rails, a ship that moves over the sea or river, and an airplane that flies into the sky using the action of air.

Also, the vehicle traveling on roads or rails may move in a predetermined direction in accordance with the rotation of at least one wheel, and may include, for example, a three- or four-wheeled vehicle, a construction machine, a two-wheeled vehicle, a prime mover, a bicycle, and a train that runs on rails.

Hereinafter, embodiments according to an exemplary embodiment of the present invention will be described in detail with reference to the accompanying drawings.

Figure 2:
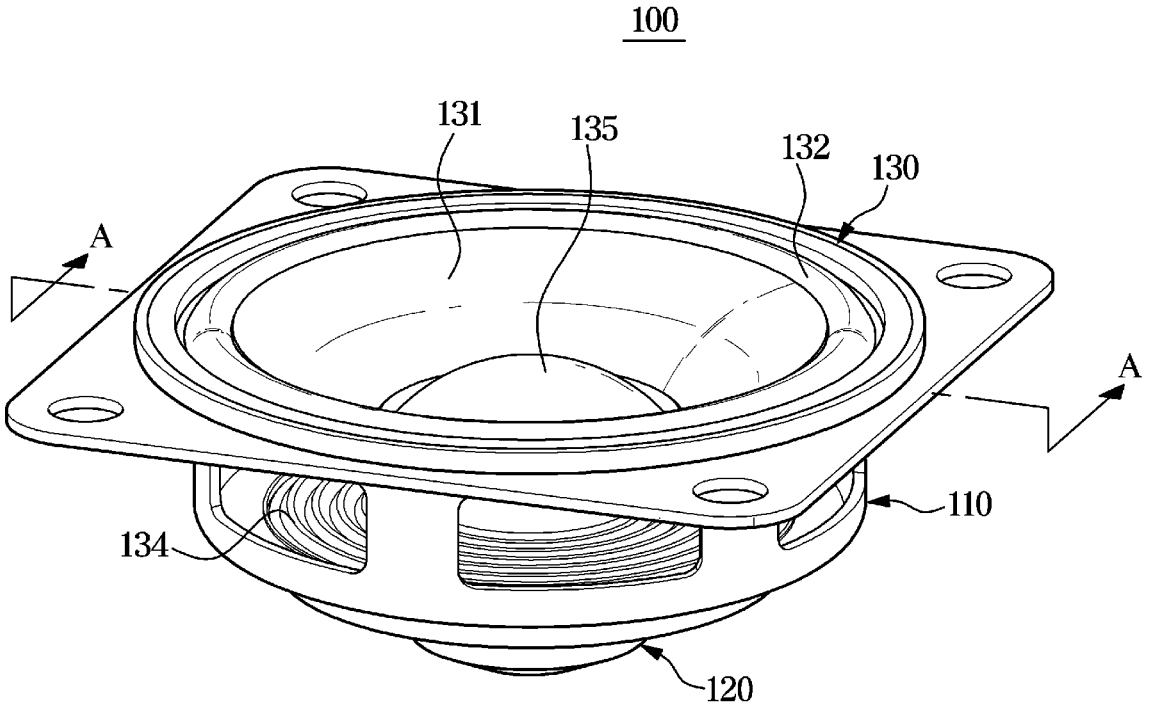
FIG. 2 is a view exemplarily illustrating the speaker device according to an exemplary embodiment of the present invention.
Figure 3:
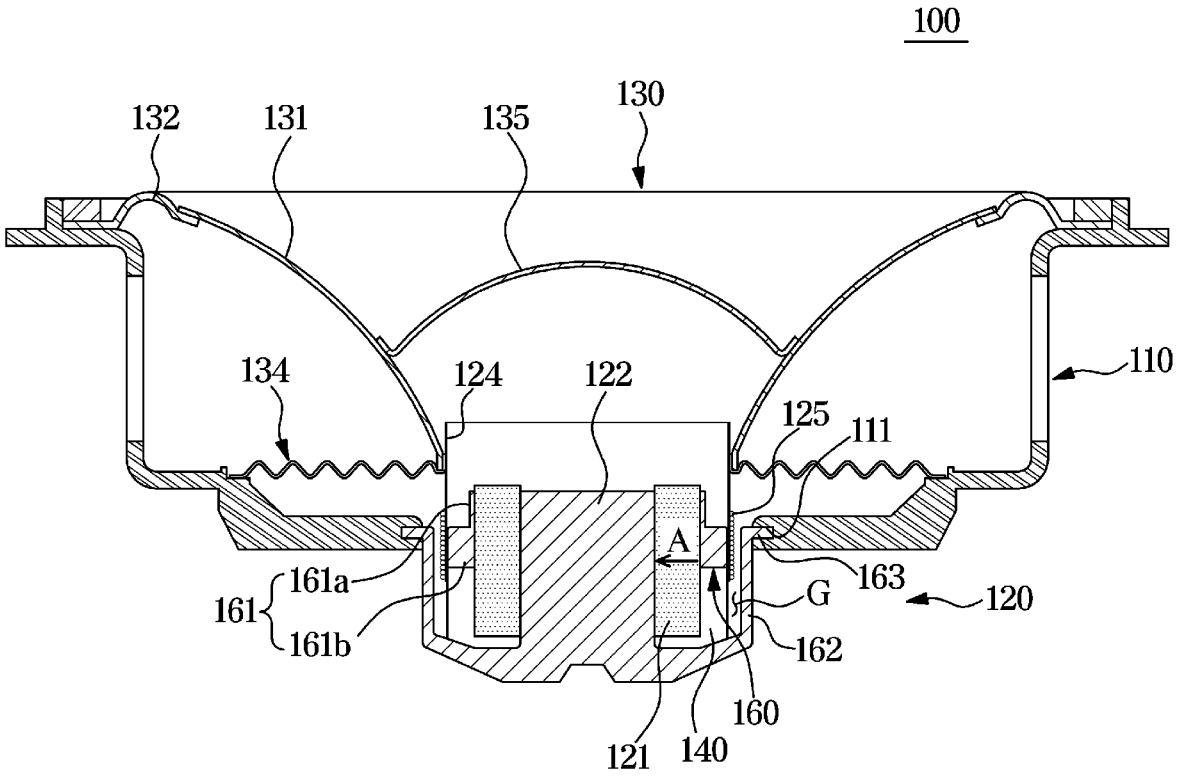
FIG. 3 is a cross-sectional view exemplarily illustrating an internal structure of the speaker device according to an exemplary embodiment of the present invention.

FIG. 1 is a view exemplarily illustrating a vehicle provided with a speaker device according to an exemplary embodiment of the present invention, FIG. 2 is a view exemplarily illustrating the speaker device according to an exemplary embodiment of the present invention, and FIG. 3 is a cross-sectional view exemplarily illustrating an internal structure of the speaker device according to an exemplary embodiment of the present invention.

As illustrated in FIG. 1, FIG. 2, and FIG. 3, a vehicle 1 may include a main body 10 forming an external appearance of the vehicle 1, a front glass 11 for providing a front view of the vehicle 1 to a driver within the vehicle 1, wheels 21 and 22 for moving the vehicle 1, a driving device 40 for rotating the wheels 21 and 22, doors 30 for shielding the inside of the vehicle 1 from the outside, and side mirrors 12*a* and 12*b* for providing a rear view of the vehicle 1 to the driver.

The front glass 11 is provided on a front upper side of the main body 10 so that the driver within the vehicle 1 may obtain visual information related to a front side thereof.

The wheels 21 and 22 may include the front wheels 21 provided on a front side of the vehicle 1 and the rear wheels 22 provided on a rear side of the vehicle 1. The driving device 40 may provide a rotational force to the front wheels 21 or the rear wheels 22 so that the main body 10 moves forward or backward thereof.

The driving device 40 may employ an engine for generating a rotational force by burning a fossil fuel, or a motor for generating a rotational force by receiving a power source from a capacitor.

The doors 30 are rotatably provided on the left and right sides of the main body 10, respectively, so that the doors 30 may allow the driver and a passenger to ride within the vehicle 1 when the doors 30 are opened and shield the inside of the vehicle 1 from the outside thereof when the doors 30 are closed.

The side mirrors 12*a* and 12*b* may be provided on the left and right sides of the main body 10, respectively, so that the driver within the vehicle 1 may obtain visual information on the sides and rear of the vehicle 1.

Although not shown in the drawings, the vehicle 1 may include a front camera for securing a front view, a left camera or a right camera for securing a side view, and may include a sensing device such as a proximity sensor for detecting an obstacle in the rear of a vehicle or a rain sensor for detecting rainfall and precipitation.

A speaker device 100 for a vehicle for outputting sound to the outside of the vehicle 1 may be provided on a front side of the main body 10. The speaker device 100 may be provided outside the main body 10 or may be provided inside the main body 10. The speaker device 100 may be mounted in a form configured for transmitting sound to the outside.

Although the present invention has exemplified that one of the speaker device 100 is mounted on the front side of the main body 10, the spirit of the present invention is not limited thereto. For example, a plurality of speaker devices may be provided to transmit sound from the left side and the right side of a vehicle, respectively.

The speaker device 100 includes a hollow frame 110, and a magnetic circuit and a vibration system provided inside the frame 110.

The magnetic circuit may include a magnet 121 for generating a magnetic flux and a yoke 120 for forming a path of the magnetic flux generated from the magnet 121.

The vibration system may include a voice coil 125 configured to move by interaction with the magnetic flux generated by the magnet 121 as the voice coil 125 is magnetized when a current is applied, a bobbin 124 on which the voice coil 125 is wound, a diaphragm 131 for generating a negative pressure by vibrating in accordance with the movement of the voice coil 125, a damper 134 for guiding the movement of the voice coil 125 in the front and rear direction and for restricting the movement of the voice coil 125 in the left and right direction, an edge portion 132 for engaging an external edge portion of the diaphragm 131 to the frame 110, and a dust cap 135 for preventing foreign substances from penetrating into the frame 110.

The dust cap 135 is mounted on an upper end portion of the bobbin 124 to prevent foreign substances from penetrating into a vibrating portion 130 such as the bobbin 124 and the voice coil 125.

The dust cap 135 may be attached and fixed to an internal center portion of the diaphragm 131.

The voice coil 125 is configured to move by interacting with a magnetic flux generated by a magnet 121, which will be described later, as the voice coil 125 is magnetized when a current is applied.

The diaphragm 131 is configured to transmit sound to the outside by varying the vibration according to the sound.

According to an exemplary embodiment of the present invention illustrates that the diaphragm 131 is formed in a funnel shape or a cone shape which is recessed toward a lower side from a center portion thereof, but an aspect of the present invention is not limited thereto. For example, the diaphragm 131, which is a key component for determining the sound quality, tone color, and frequency characteristics of the speaker device 100, may be formed with different acoustic characteristics depending on its material, mass, and structure.

Also, according to an exemplary embodiment of the present invention illustrates that the frame 110 is formed in a cylindrical shape, but an aspect of the present invention is not limited thereto. For example, the frame 110 may include a funnel or a cone shape whose upper end portion thereof is formed to have a diameter greater than its lower end portion.

The frame 110 forms an external appearance of the speaker device 100. The magnetic circuit may be disposed on a lower side of the frame 110, and the vibration system may be disposed on an internal upper side of the frame 110.

Hereinafter with respect to the surfaces and directions of the frame 110 and other components, a surface and a direction facing upward in the vertical direction of the frame 110 will be referred to as an 'upper surface' and an 'upper side,' and a surface and a direction facing downward in the vertical direction of the frame 110 will be referred to as a 'lower surface' and a 'lower side.'

The magnetic circuit is a portion to which an electrical signal is transmitted to generate sound of the speaker device 100. The magnet 121 of the magnetic circuit has a plurality of poles including one N pole and one S pole.

The magnet 121 may be accommodated in a horizontal direction (direction A). The horizontal direction A is a direction of a magnetic circuit (path) in the speaker device 100. The seating direction A of the magnet 121 is the same as the magnetic path forming direction A. The seating direction A of the magnet 121 may be disposed on the same line as the magnetic path forming direction A. The seating direction of the magnet, which refers to a magnetic path forming direction in the speaker device, corresponds to the horizontal direction in FIG. 3.

The magnet 121 may include a hollow annular shape. The magnet 121 is formed to have a predetermined height and thickness. The magnet 121 includes neodium. According to an exemplary embodiment of the present invention illustrates that the magnet includes neodium, but an aspect of the present invention is not limited thereto. For example, the magnet may include ferrite or other permanent magnet material.

The yoke 120 includes a pole piece 122 and a plate member 160 provided outside the pole piece 122.

A magnetic gap G may be formed between the plate member 160 and the pole piece 122. The plate member 160 may include a bottom plate 162 extending from a lower end portion of the pole piece 122. The magnetic gap G of a predetermined space may be formed between the bottom plate 162 and the pole piece 122 and at least a portion of the bottom plate 162 may extend upward to be connected to the frame 110. At least a portion of the bottom plate 162 may be injection-molded integrally with the frame 110. The plate member 160 may be formed of a magnetic material of low magnetoresistance including steel, alloy or other magnet material. According to an exemplary embodiment of the present invention illustrates that the bottom plate 162 is formed integrally with the pole piece 122, but an aspect of the present invention is not limited thereto. For example, the bottom plate 162 and the pole piece 122 may be formed separately and coupled together.

The plate member 160 may be provided to be injection-molded integrally with the frame 110. The bottom plate 162 may be injection-molded integrally with the frame 110. The plate member 160 may include a frame engaging portion 163 for minimizing leakage magnetic flux. The bottom plate 162 may include the frame engaging portion 163 for minimizing leakage magnetic flux. The frame engaging portion 163 may be formed in a shape of '⌈'. The frame engaging portion 163 may be provided to minimize leakage magnetic flux between the plate member 160 and the frame 110 and allow integral injection molding. The frame 110 may be formed with a plate engaging portion 111 corresponding to the frame engaging portion 163. The magnet 121 may be mounted on the outside of the pole piece 122. The pole piece 122 may be provided to form a path of the magnetic flux generated by the magnet 121.

The plate member 160 may include a top plate 161 mounted radially outward of the magnet 121. The top plate 161 may be formed in a substantially L shape. The top plate 161 may include a first plate portion 161*a* and a second plate portion 161*b* extending from the first plate portion 161*a*.

The top plate 161 is provided to support the magnet 121 from the outside of the magnet 121 and includes a shape for maximizing the gap of the magnetic flux emitted from the magnet 121.

The second plate portion 161*b* is provided to extend downwardly from the first plate portion 161*a* and may be formed to have a width wider than the width of the first plate portion 161*a*. The top plate portion 161 may be formed such that the width of a lower portion is wider than the width of an upper portion. The cross section of the top plate portion 161 may include an L shape.

A spacer 140 may be provided at a lower portion of the magnet 121 and the top plate 161 to prevent leakage magnetic flux. The spacer 140 may be provided to support the lower portion of the magnet 121 and the top plate 161. The spacer 140 may be formed of a non-magnetic material. The spacer 140 may be inserted to prevent leakage magnetic flux generated from the lower portion of the magnet 121 and the top plate 161.

In an exemplary embodiment of the present invention, the spacer 140 is provided between a lower portion of the magnet 121, the top plate 161, the bobbin 124 and the bottom plate 162 to prevent leakage magnetic flux.

The yoke 120 may seat the magnet 121 in the horizontal direction such that the magnetic path forming direction and the seating direction of the magnet 121 are disposed on the same line, smoothly flowing the magnetic flux to improve the efficiency of the leakage magnetic flux and increase the efficiency of the speaker.

As is apparent from the above, various aspects according to various aspects of the present invention, the size of a magnet may be reduced by a structure in which a seating direction of the magnet coincides with a magnetic path forming direction thereof, increasing the efficiency.

Furthermore, the shape of a plate may be improved to smooth the flow of the magnetic flux, increasing the efficiency.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A speaker device for a vehicle, the speaker device comprising:

a frame;

a magnet mounted in the frame to generate a magnetic flux;

a yoke having a magnetic gap to form a magnetic path generated by the magnet;

a voice coil mounted in the magnetic gap to move when a current is applied to the voice coil;

a diaphragm engaged to the voice coil and configured to vibrate according to movement of the voice coil and generate a negative pressure;

a first plate configured to support the magnet;

a second plate; and a bobbin disposed on a surface of the second plate and onto which the voice coil is mounted, the diaphragm engaged to the bobbin, wherein the magnet is accommodated in a horizontal direction such that a seating direction and a magnetic path forming direction of the magnet coincide with each other, wherein the first plate includes a first plate portion and a second plate portion extending downwardly from the first plate portion, wherein the second plate portion is formed to have a width wider than a width of the first plate portion, wherein the magnetic gap is formed between the bobbin and the second plate, and wherein the first plate configured to support the magnet is mounted between the magnet and the bobbin.

2. The speaker device according to claim 1, wherein the magnet is disposed on a same line as the magnetic path forming direction.

3. The speaker device according to claim 1, wherein a spacer is provided between a lower portion of the first plate and a portion of the second plate to prevent leakage magnetic flux.

4. The speaker device according to claim 3, wherein the spacer is formed of a non-magnetic material.

5. The speaker device according to claim 1, wherein the first plate is formed of an L shape.

6. The speaker device according to claim 1, wherein a spacer is provided at a lower portion of the magnet and the first plate to prevent leakage magnetic flux.

7. The speaker device according to claim 6, wherein the spacer is formed of a non-magnetic material.

8. The speaker device according to claim 1, wherein the first plate is provided to be injection-molded integrally with the frame.

9. The speaker device according to claim 8, wherein the first plate is formed in a shape of 'r' to be injection-molded integrally with at least a portion of the frame.

* * * * *